US005676109A

United States Patent [19]

Eisenbacher et al.

[11] Patent Number: 5,676,109

[45] Date of Patent: Oct. 14, 1997

[54] HYDRAULIC SYSTEM, IN PARTICULAR AN ENGINE BRAKE FOR AN INTERNAL COMBUSTION ENGINE

[75] Inventors: Egon Eisenbacher, Karlstadt; Manfred Unger, Kleinostheim; Burkhard Willig, Hösbach, all of Germany

[73] Assignee: Mannesmann Rexroth GmbH, Lohr/Main, Germany

[21] Appl. No.: 727,448

[22] PCT Filed: Apr. 25, 1995

[86] PCT No.: PCT/EP95/01558

§ 371 Date: Oct. 18, 1996

§ 102(e) Date: Oct. 18, 1996

[87] PCT Pub. No.: WO95/29325

PCT Pub. Date: Nov. 2, 1995

[30] Foreign Application Priority Data

Apr. 26, 1994 [DE] Germany ..... 44 14 401.6

[51] Int. Cl.[6] ..... F02D 13/04

[52] U.S. Cl. ..... 123/322

[58] Field of Search ..... 123/322, 321, 123/320, 323, 90.17, 90.16, 347, 348

[56] References Cited

U.S. PATENT DOCUMENTS

| | | | |
|---|---|---|---|
| 4,936,273 | 6/1990 | Myers | 123/322 |
| 5,495,838 | 3/1996 | Johnson, Jr. | 123/322 |
| 5,595,158 | 1/1997 | Faletti et al. | 123/321 |
| 5,603,300 | 2/1997 | Feucht et al. | 123/322 |
| 5,609,134 | 3/1997 | Schmidt et al. | 123/322 |

FOREIGN PATENT DOCUMENTS

| | | | |
|---|---|---|---|
| 2559029 | 7/1977 | Germany | 123/322 |
| 4002856 | 8/1991 | Germany | 123/322 |
| 4038334 | 11/1991 | Germany | 123/322 |
| 4121435 | 1/1993 | Germany | 123/322 |
| 4138447 | 5/1993 | Germany | 123/322 |

*Primary Examiner*—Raymond A. Nelli

*Attorney, Agent, or Firm*—Martin A. Farber

[57] ABSTRACT

The invention is based on a hydraulic system, in particular of an engine brake for an internal combustion engine, having at least one hydraulic actuating element, a positive displacement pump by which pressurized fluid can be pumped from a low-pressure region into a high-pressure region, and a distributor unit (14) having a control output (13) which is connected via a control line with the actuating element, which control output can be pressurized from the high-pressure region and connected to the low-pressure region. In order to obtain the desired control of the actuating elements over a wide range of cycle times and speeds of rotation of the internal combustion engine with a pump of relatively small displacement, a return valve which opens towards the high-pressure region is provided, via which the control line can be connected to the high-pressure region after it has been pressurized from the high-pressure region and before it is connected to the low-pressure region. In this way, excessive carry-over of pressurized fluid from the high-pressure region into the low-pressure region is prevented, so that a positive displacement pump of relatively small displacement is sufficient to produce the pressure desired.

16 Claims, 4 Drawing Sheets

23
46
14
21
15
35
50
33
53
32
47
107
40
37
55
63
75
105
49
74
38
27
36
64
65
66
67
48
62
61
42
68
80
72
43
13
26
52
54
71
34
51
85
106
70
24
39
28
22
25

HYDRAULIC SYSTEM, IN PARTICULAR AN ENGINE BRAKE FOR AN INTERNAL COMBUSTION ENGINE

FIELD AND BACKGROUND OF THE INVENTION

The present invention is based on a hydraulic system which can be used, in particular, as an engine brake for an internal combustion engine.

Such a hydraulic system is known in its use as engine brake from Federal Republic of Germany 41 21 435 A1. In that case, a so-called decompression valve is associated with each cylinder of the internal combustion engine, the valve being actuated outside the exhaust cycle of the working piston of a cylinder and in particular at the end of the compression cycle, by the action of pressure on a hydraulic piston serving as actuating member. The source of pressurized fluid for the system is a positive-displacement pump, in particular a radial piston pump, by which pressurized fluid can be pumped from a low-pressure region into a high pressure region. A distributor unit has a number of control outputs which corresponds to the number of decompression valves, each of said control outputs being connected by a control line to a hydraulic piston. When operated as a brake, the control outputs are pressurized via the distributor unit from the high pressure and connected to the low pressure with a cycle time which is linearly dependent on the speed of rotation of the internal combustion engine. The dependence of the cycle time on the speed of rotation of the internal combustion engine is obtained, for example, in simple fashion in the manner that the distributor unit has a distributor rotor which is turnable with respect to the control outputs and is driven, via a step-down transmission, directly by the internal combustion engine with half the speed of rotation of the latter.

In practical tests on a model, it was found that the desired intensity of the braking action is not obtained at all speeds of rotation of the internal combustion engine. Within these speed ranges, the amount of pressurized fluid pumped by the positive displacement pump used is not sufficient to maintain the desired pressure in the high-pressure region. In principle, it is possible to use a positive displacement pump of greater displacement. This, however, has the result that, upon normal operation of the internal combustion engine, and therefore when braking is not to be effected, and the high-pressure region is relieved of pressure, the positive displacement pump absorbs a high motoring power which reduces the useful output of the internal combustion engine. On the other hand, within speed ranges in which previously the amount of pressurized fluid pumped by a smaller positive displacement pump had been sufficient, a large amount of oil flows off via the pressure-limiting valve which controls the pressure in the high-pressure region and is strongly heated thereby. New problems can result from this.

SUMMARY OF THE INVENTION

The object of the present invention, therefore, is to improve a hydraulic system which is used, in particular, as engine brake for an internal combustion engine and has the features set forth in the preamble to claim 1, in such a manner that, while retaining a positive displacement pump of relatively small displacement over the entire range of the cycle times in which the control outputs are acted on by pressure and relieved of pressure, the desired control of the actuating elements is retained and, therefore, the desired braking action can be obtained over the entire speed range of the internal combustion engine when the hydraulic system is used as engine brake.

This object is achieved in accordance with the invention by a hydraulic system which has the features set forth in the preamble to claim 1 and, in addition, in accordance with the body of claim 1 has a return valve which opens towards the high-pressure region and via which the control line leading from a control output to an actuating element can be disconnected from the high-pressure region upon the end of its pressurization and connected to the high-pressure region before its connection to the low-pressure region.

The invention first of all is based on the idea that a control line is pressurized from the high-pressure region, a pressure can occur which is substantially higher than—for example twice as high as—the pressure in the high-pressure region on the basis of pressure-wave processes in the control line. Accordingly, if it is assumed that at the start of the pressurization from the high-pressure region, the control line is filled with oil and the pressure of the low-pressure region of, for instance, 1.5 bar prevails in it, while during the pressurization an amount of oil flows into the control line which corresponds to the increase in volume by the displacement of the actuating element, plus an amount of compression oil which is necessary in order to build up in the control line the pressure which prevails in the high-pressure region, plus again this same amount of compression oil in order to double this pressure. Through the return valve, it is now possible, during an expansion which follows the compression of the oil in the control line, to conduct oil returning from the control line into the high-pressure region before the control line is relieved towards the low-pressure region. In this way, the amount of oil which passes upon each pressurization of a control line from the high-pressure region into the low-pressure region is reduced, so that a positive-displacement pump of relatively small displacement can be used as source of pressurized fluid. The return valve, therefore, permits pressurized fluid to flow back from the control line into the high-pressure region but, on the other hand, prevents it that, after an expansion wave which travels forward and back in the control line, a compression wave and an expansion wave following it are again excited from the high-pressure region, which would still lead to an increased carry-over of oil out of the high-pressure region into the low-pressure region. Thus, the actuating elements are controlled in the manner desired in the entire range of the cycle times. With an engine brake for an internal combustion engine which is developed in accordance with the invention, the desired braking action is obtained over the entire speed range of the internal combustion engine.

Thus, in accordance with claim 2, a number of return valves corresponding to the number of control lines which can be separately pressurized are present, each of them serving to open a control line towards the high-pressure region. A control line can then be continuously connected with the feed of the associated return valve. The return valves can then be readily arranged in a fixed position with respect to the control outputs and the control lines.

If the distributor unit has a distributor rotor which rotates opposite said at least one control output, then it is also possible, in accordance with claim 3, for a return valve via which the control output and a control line connected to it can be connected to the high-pressure region to be arranged on the distributor rotor. Such an arrangement is of great advantage, in particular when several control outputs are present, as is generally true in the case of an engine brake for an internal combustion engine, since the internal combustion engine of a motor vehicle is ordinarily a multi-cylinder internal combustion engine which has a number of decompression valves corresponding to the number of cylinders which it has. In accordance with claim 4 several control outputs are preferably adapted to be connected to the high-pressure region via the same return valve arranged on the distributor rotor. Thus, only one return valve need be provided for several control outputs.

In the manner known per se from Federal Republic of Germany 41 21 435 A1, the distributor rotor can have a pressure recess via which a control output can be pressurized from the high-pressure region, and a relief recess via which the control output can be connected to the low-pressure region. The control output is then, in accordance with claim 5, preferably adapted to be connected with the high-pressure region via a decompression recess which is present between the pressure recess and the relief recess and is separate from said recesses and via a return valve arranged on the distributor rotor downstream of said decompression recess. It has then been found particularly advantageous if, in accordance with claim 6, a sealing bar present between the pressure recess and the decompression recess is shorter in the direction of rotation of the distributor rotor than a control output which lies opposite the recesses. The control output is then namely not closed upon change from the pressure recess to the decompression recess, so that any pressurized fluid possibly already flowing back from the control line does not come against a closed wall. Peak forces on the distributor rotor, and particularly pressure waves in the control lines, are accordingly avoided.

In the region of the decompression recess, there is not merely a sealing bar between it and the pressure recess. Sealing bars can separate the decompression recess also from the low-pressure region and from the high-pressure region. As a whole, therefore, the sealing surface in the region of the decompression recess is rather large, so that the surface of action for a pressure which is greater than the low pressure is large and there is a tendency for the sealing bars to lift off from their mating surfaces. In order to reduce the surface of action, a relief groove connected with the low-pressure region is introduced, in accordance with claim 7, into a sealing bar of the distributor rotor which is present radially or axially between the decompression recess and the high-pressure region.

A relief groove connected with the low-pressure region is advantageously introduced also into a sealing bar which separates the pressure recess over at least a part of its length in radial or axial direction from the high-pressure region. This development already has advantages, aside from features contained in the preceding claims, since in this way the force acting in lift-off direction on the distributor rotor is reduced.

If the high-pressure region is located radially outward or inward on the distributor rotor, it is preferable, in accordance with claim 9, for the return valve to be so arranged on the distributor rotor that its axis lies at least approximately in a radial plane. In such case, the discharge path from the return valve to the high-pressure region can be produced in a particularly simple manner.

Claims 10 to 14, finally, refer to developments of the return valve which permit said valve to switch particularly rapidly.

BRIEF DESCRIPTION OF THE DRAWINGS

With the above and other advantages in view, the present invention will become more clearly understood in connection with the detailed description of preferred embodiments, when considered with the accompanying drawings, of which.

DETAILED DESCRIPTION OF THE PREFERRED EMBODIMENTS

Figure 1:
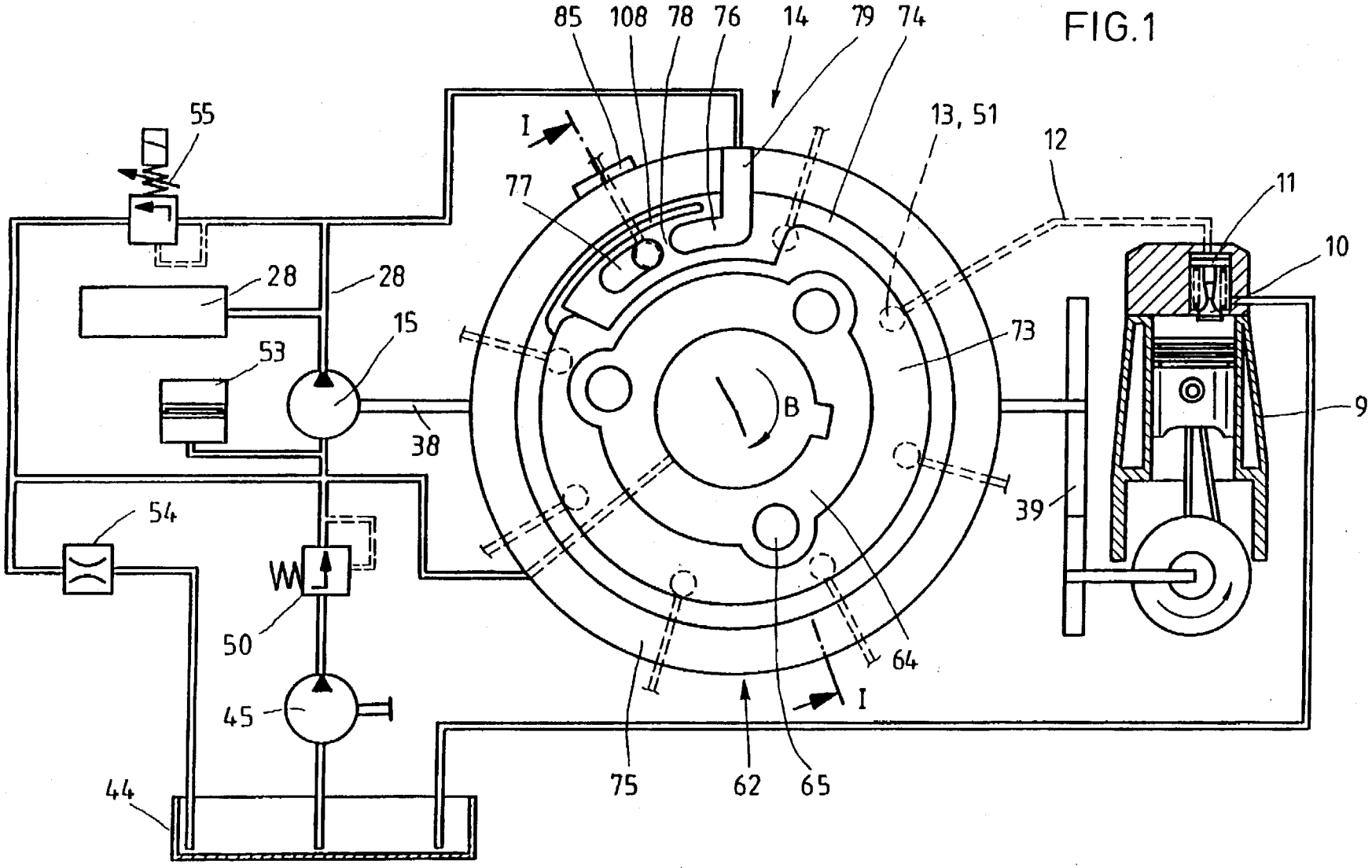
FIG. 1 shows the engine brake as an entire system, the individual components being indicated only diagrammatically, except for the distributor rotor, which is shown in an axial view.

The engine brake shown operates in accordance with the principle of a decompression brake and is designed for an internal combustion engine 9 with eight cylinders. For reasons of simplicity, only one combustion chamber of the internal combustion engine with decompression valve 10 is shown. Upon operation as brake, the decompression valve is briefly opened at the end of the compression cycle so that the compressed air can flow out of the combustion chamber. In this way the compression work of the working piston is made usable for the braking during the compression cycle.

The decompression valve 10 can be actuated by a hydraulic piston 11, which can be acted on with pressure and relieved of pressure via a corresponding control line 12. For simplicity in showing, only a single control line 12 is shown in its entirety in FIG. 1.

For each decompression valve 12 there is provided a separate control line 12 which extends from a control output 13 of a total of eight control outputs 13 of a distributor device 14. In braking operation, the hydraulic pistons 11 are acted on with pressure in the correct sequence and in a cycle which is adapted to the corresponding speed of rotation of the internal combustion engine via the distributor unit and the control lines from the high-pressure region of a radial piston pump 15 and relieved of pressure by a connection of the corresponding control line with the low-pressure region of the pump 15.

Figure 2:
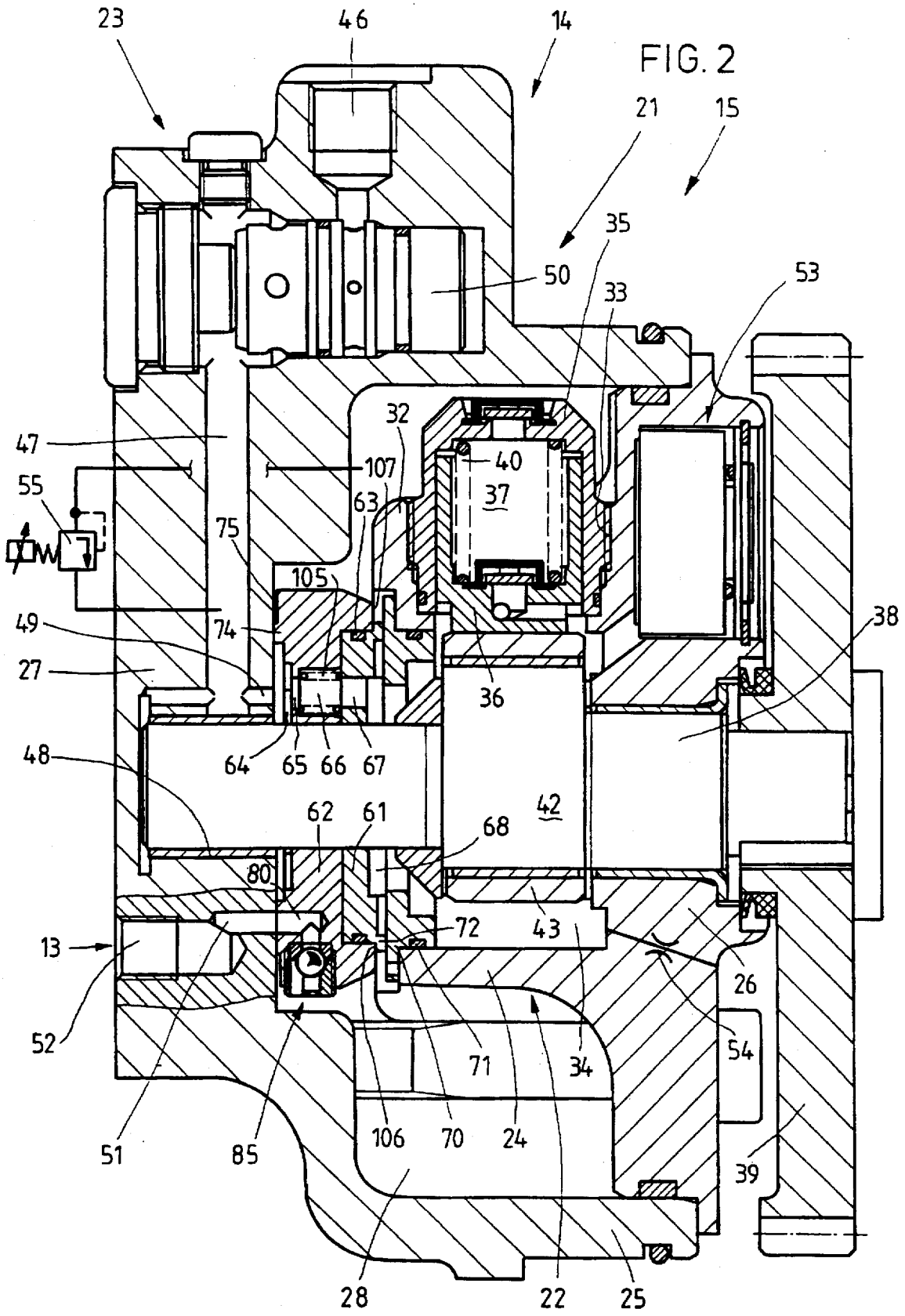
FIG. 2 is an axial section through the hydraulic pump of the system which serves as source of pressurized fluid and which also shows the distributor unit.
Figure 3:
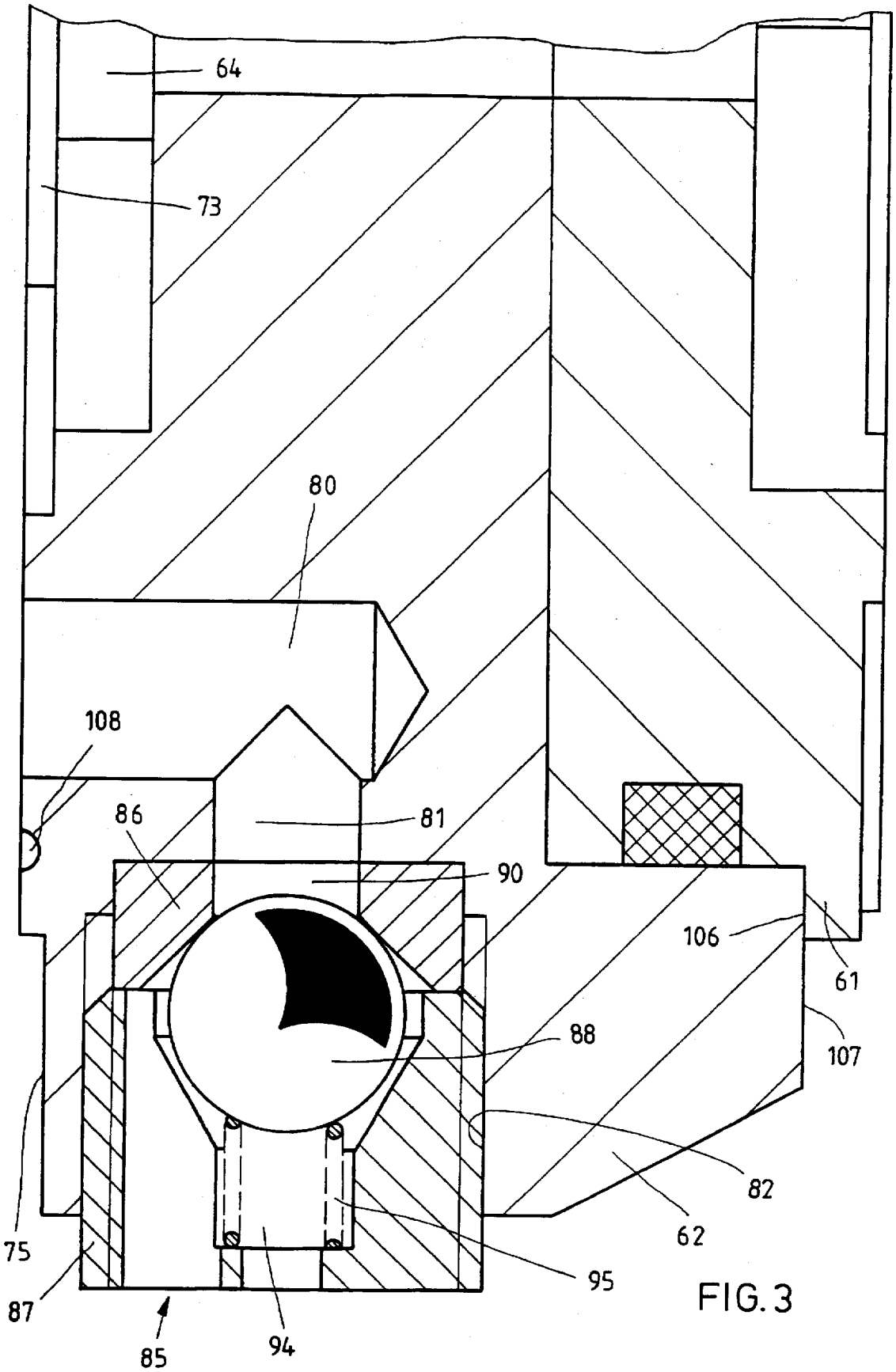
FIG. 3 shows, on a larger scale, a portion of FIG. 2 in the region of the return valve on the distributor rotor.
Figure 4:
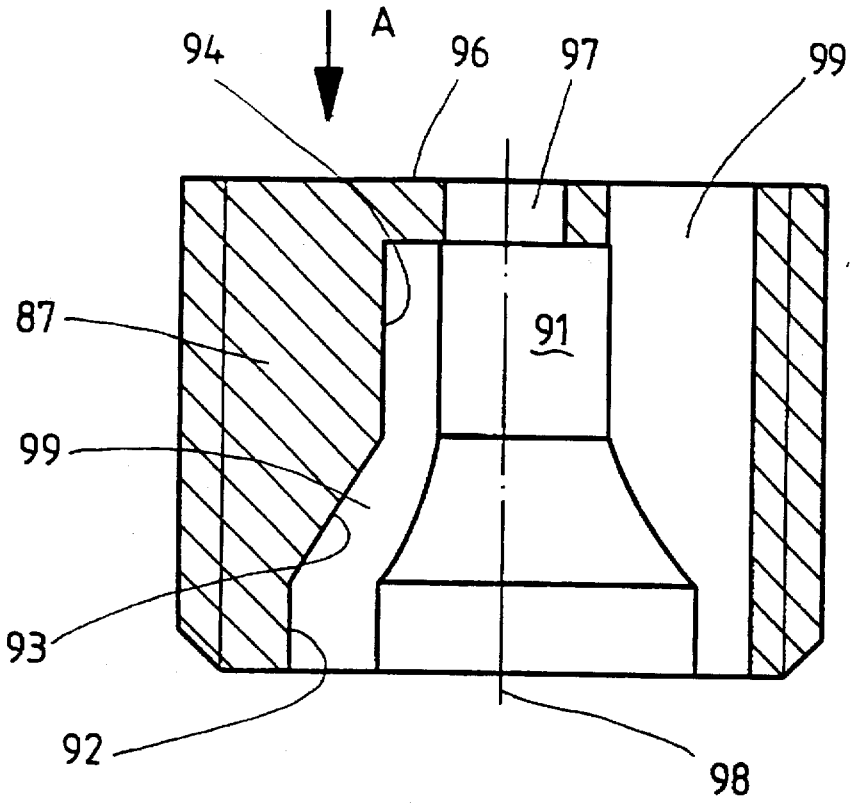
FIG. 4 is a section through the housing of the return valve.
Figure 5:
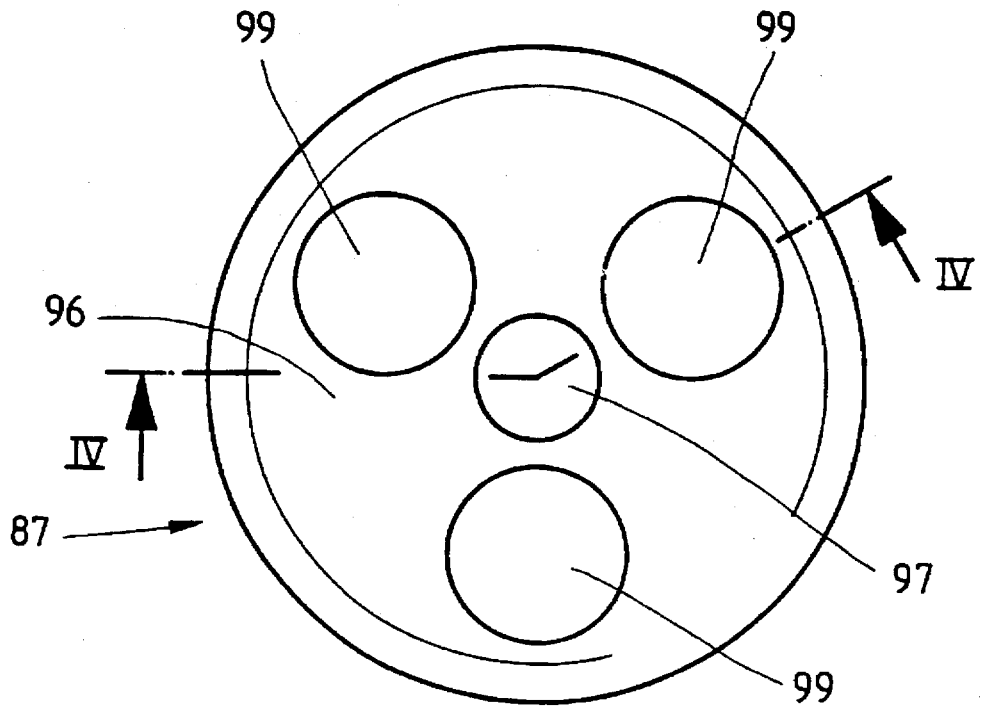
FIG. 5 is a top view of the housing of the return valve seen in the direction indicated by the arrow A in FIG. 4.

The distributor unit 14 and further hydraulic components are integrated in the radial piston pump 15, which is shown in further detail in FIG. 2 and has a bipartite pump housing with a first housing part 22 and a second housing part 23. Both housing parts are pot-shaped with pot walls 24 and 25 respectively and pot bottoms 26 and 27 respectively and inserted one into the other in opposite positions. The pot wall 24 of the first housing part 12 is substantially smaller in cross section than the hollow space surrounded by the pot wall 15 of the second part, so that the first housing part 12 fits into the second housing part 13 and a relatively large space 28 is present between the two housing parts.

At the same angular distance from each other, several extensions 32 are developed on the outside of the pot wall 24 of the first housing part 22, through which extensions stepped bore holes 23 extend from the outside up into the hollow space 34 surrounded by the pot wall 24 of the first housing part 22. Into each bore hole 33 there is screwed a cylinder housing 35 which receives a radial piston 36. A coil compression spring 40 arranged in the displacer chamber 37 surrounded by the cylinder housing 35 and the radial piston 36 is clamped between the cylinder housing 35 and the radial piston 36 and acts in a radially inward direction on the radial piston 36.

A drive shaft 38 of the pump is rotatably supported in the bottom 26 of the first housing part 22 and in the bottom 27 of the second housing part 23 and can be driven, via a gear wheel 39 which is connected fixed in rotation with it, by the internal combustion engine 9 at half the speed of rotation of the internal combustion engine. Within the hollow space 34, the drive shaft 38 has an eccentric 42 on which an eccentric ring 43 is rotatably mounted. The radial pistons 36 are pressed against this eccentric ring 43 by the compression springs 40. When the drive shaft 38 rotates, the radial piston carries our a reciprocating movement in radial direction under the influence of the eccentric 42, the compression springs 40 and the pressure prevailing in the displacer chambers 37, in which connection pressurized fluid is drawn out of the hollow space 34, which is part of the low-pressure region of the system, and delivered into the intermediate space 28 which is the high-pressure region of the pump.

Through the second housing part 23 there extends a low-pressure feed channel into which lubricating oil is pumped as pressurized fluid from a lubricating oil pan 44 by a lubricating oil pump 45, shown in FIG. 1, of a motor vehicle. The feed channel extends from a connection 46 of the second housing part 23 and is formed, to the greatest part, by a bore hole 47 which extends radially to the drive shaft 38 in the bottom 27 of the second housing part 23 up to a blind hole 48 in the bottom 27 which hole serves for the mounting of the drive shaft 38. The hole 47 is traversed by an axial hole 49 which is at a slight distance from the blind hole 48 and, in the same way as the latter, is open towards the inside. Between the connection 46 and the hole 47, a pressure-reduction valve 50 is installed which maintains a low feed pressure, for instance 1.5 bar, at its output, and therefore in the hole 47 and in the entire low-pressure region of the pump.

Radially further to the outside than the axial hole 49 there are present in the bottom 27 of the second housing part 23, further axial holes 51 which are open towards the inside and all of which are at the same distance from the axis of the blind hole 48 and thus from the drive shaft 38 and have the same angular spacing from each other. The axial holes 51 are connected with control connections 52 of the housing part 23 and together with them form the control outputs 13 of the distributor unit 14. The control lines 12 leading to the hydraulic pistons 11 are connected to the connections 52.

As further hydraulic components, there can be noted in FIGS. 1 and 2 a low-pressure pulsation damper 53, a flushing nozzle 54 which is connected between the hollow space 34 and the oil pan 44, and an electromagnetically displaceable pressure-limiting valve 55 the inlet of which is connected with the space 28, and therefore with the high-pressure region of the pump 15, and the outlet of which is connected with the hole 47, and therefore with the low-pressure region of the pump. Upon the normal operation of a motor vehicle the pressure-limiting valve is set to a very low pressure so that the pump 15 pumps only upon rotation and is driven along by the internal combustion engine with low power. In braking operation, a high pressure in the region of, for instance, 100 bar is set by the pressure-limiting valve 55. The space 28 between the two housing parts 22 and 23 is shown in FIG. 1 as volume resonator which contributes to smoothing pressure peaks in the high-pressure region of the pump 15.

Since the control outputs of the distributor unit 14 and the high-pressure region 29 and the low-pressure region are located in the housing 21, the latter can also be considered stator of the distributor unit 14 which, in addition, has a distributor rotor which consists essentially of the drive shaft 38 and of two distributor disks 61 and 62 seated, fixed for rotation on the drive shaft 38, between the two housing parts 22 and 23 and via which the control outputs can be connected with the high-pressure region and the low-pressure region. The first distributor disk 61 is located close to the first housing part 22, and the second distributor disk 62 is located close to the second housing part 23. The two distributor disks are guided telescopically directly in one another, the first distributor disk 61 being contained in a recess in the second distributor disk 62. A radial seal 63 is present between the two distributor disks. An annular groove 64 of the distributor disk 62 lies opposite the axial hole 49, from which groove there extend at its edge a plurality of axial holes 65, each of which passes through the bottom of a blind hole 66 which is introduced into the distributor disk 62 from the side facing away from the housing part 23. Aligned with the blind holes 66, axial holes 67 also pass through the first distributor disk 61 and debouch in a recess 68 on the face of the distributor disk 61 facing away from the distributor disk 62. A connection to the hollow space 34 is present from the recess 68 via a central opening in a ring 70 which reduces the size of the outlet of the hollow space 34. Between the ring 70 and the inner side of the pot wall 24, there is a radial seal 71. Thus, oil can pass from the outlet of the pressure-reduction valve 50 via the hole 47, the hole 49, the annular groove 64, the holes 65, 66, and 67, the recess 68, and the central opening in the support ring 70 into the hollow space 34 of the first housing part 32 from which the radial pistons 36 draw oil. At its edge, the first distributor disk 61 has a sealing bar 72 which extends around the recess 68 and with which the disk can be pressed axially against the support ring 70 so that it separates the hollow spaces 34 and 28 from each other.

In the face facing the housing part 23, the distributor disk 62 has alongside the annular groove 65 a low-pressure control groove 73 which extends over a finite angle, is located radially outside of the annular groove, is axially less deep than the annular groove 64, and is open towards the annular groove 64. Radially towards the outside, the low-pressure control groove 73 is separated by a sealing bar 74, by which the distributor disk 62 can be pressed against the housing part 63, from a milling 75 in the distributor disk 62 which is open axially towards the housing part 23 and radially outwards towards the space 28. Between the two peripheral ends of the low-pressure control groove 73, the sealing bar 74 is widened radially inwards in order to create space within the sealing bar for an arcuate pressure groove 76 and a similarly arcuate decompression groove 77. The two grooves 76 and 77 are at the same distance from the axis of the distributor disk 62 and are separated from each other in peripheral direction by a section 78 of the sealing bar 74. The grooves 73, 76 and 77 are aligned with the axial holes 51 in the housing part 23. The pressure groove 76, is connected at its end further peripherally from the decompression groove 77, via a radial groove 79 with the space 28 and therefore with the high-pressure region of the pump 15 and of the distributor unit 14.

In the bottom of the decompression groove 77 there is an axial blind hole 80 which is connected via a radially outward extending connecting hole 81 with a receiver 82 which is introduced radially from the outside into the distributor disk 62 and into which a return valve 85 is inserted which consists of a valve seat 86, a housing 87, and a ball 88 as valve-closure member. The ball 88 is made of a ceramic material, particularly silicon nitride. The direction of the axis of the return valve and the direction of movement of the ball 88 are radial with respect to the axis of the distributor disk 62 and of the drive shaft 38. At the base of the recess 82 there is located the valve seat 86 which, by a central passage 90 which widens conically radially outwards, is aligned with the connecting hole 81. The housing 87 has a central receiving space 91 which is open towards the valve seat 86 and which has, towards the valve seat 86, a circular-cylindrical section 92, a frustoconical section 93 adjoining same, and a blind-hole-like section 84 following the latter. The ball 88 can move within the conical section of the central passage 90 of the valve seat 86, and within the sections 92 and 93 of the central receiver 91 in the housing 87. In the section 94 of the housing 87 there is contained a coil compression spring 95 which urges the ball 88 in the direction towards the valve seat 86, acts against the slight centrifugal forces acting on the ball 88 and contributes thereto that the closing process of the return valve which commences at the end of the return flow of pressurized fluid from the control line takes place very rapidly.

It also contributes to a rapid closing of the return valve 85 that the ball 88 can be acted on directly by the pressurized fluid on the side thereof facing away from the valve seat 86. The radial arrangement of the return valve permits this in simple fashion. One or more axial passages need merely be created between the central receiving space 91 and the rear side 96 of the housing 87. In the embodiment shown, a total of four such passages in the form of holes are present. A first hole 97 is present in the axis 98 of the housing 87 and debouches centrally into the receiving space 91. Furthermore, the valve housing 87 has three other holes 99 which are equivalent to each other, which extend parallel to the axis 98 of the housing 87 and are arranged in triple symmetry to said axis. The distance of the axes of the holes 99 from the axis 98 as well as the size of the sections 92 and 93 of the receiving space 91 and the diameter of the holes 99 are so adapted to each other that a part of the cross section of the holes 99 debouches axially into the receiving space 91 but also cuts it radially from the outside. In this way, with the valve open, the cross-sectional opening is greater than in a case in which holes 99 lie entirely within the section 92 of the receiving space 91.

The two distributor disks 61 and 62 are pressed with a certain force against the housing part 22 and the support ring 70 as well as against the housing part 23. This force is produced in two different manners. On the one hand, compression springs 105 are inserted into the blind holes 66 of the distributor disk 62, the springs pressing the two distributor disks apart. On the other hand, a pressure surface 106 on the first distributor disk 61 is not equalized in pressure and a pressure surface 107 on the second distributor disk 62 is only partially equalized in pressure by the milling 75 so that, upon braking operation, the two distributor disks are also pressed apart by the high pressure then prevailing in the space 28. The force produced by this pressure by far predominates over the force produced by the springs 105, the function of which is merely to press the distributor disks against the housing parts already when there is an absence of high pressure.

In order that the pressure forces which act in the region of the pressure groove 76 and the decompression groove 77 against the distributor disk 62 in the sense of a lifting off from the housing part 23 are kept slight, a relief groove 108 extends along between said two grooves and the milling 75 in the sealing bar and ends at a distance from the radial groove 79, terminating at a peripheral end of the low-pressure control groove 73.

When an internal combustion engine of a motor vehicle provided with the engine brake shown is operating, it drives the drive shaft 38 via the gear wheel 39. The radial pistons 36 slide on the eccentric ring 43 and carry out their displacement movements. The distributor disks 61 and 62 are driven along by the drive shaft. In normal operation when the engine brake is not used, the pressure-limiting valve 55 is set at a low pressure. The pump is driven along with low output. The distributor disks lie against the housing parts only on basis of the force of the springs 105, so that they are also driven along practically without power.

For the use of the engine brake, the pressure-limiting valve is set at a high pressure of, for instance, 100 bar. This pressure than prevails in the space 28 between the two housing parts 22 and 23. Let us now consider a given control output 13 which may be present momentarily axially over the low-pressure control groove 73. Low pressure therefore prevails in the corresponding control line. The corresponding decompression valve 10 is closed. While the distributor disk 62 now turns in the direction indicated by an arrow B in FIG. 1, the control output passes over the radial section of the sealing bar 74 between the one peripheral end of the control groove 74 and the pressure groove 76 over the pressure groove 76. Pressurized fluid now flows from the high-pressure region 28 into the control line 12, in which connection, due to pressure-wave processes, there is temporarily produced a pressure which is higher than the pressure in the high-pressure region of the pump 15 and the distributor unit 14. The pressure-wave processes lead, even before the reconnecting of the control output in question with the low-pressure control groove 74, to a reversal of the direction of flow of the pressurized fluid in the control line. Pressurized fluid can now flow back into the high-pressure region through the decompression groove which follows the pressure groove in the direction of rotation of the arrow B and is connected by the return valve 85 with the high-pressure region. It is important that pressurized fluid can flow back via the return valve 85 into the high pressure region, but that no pressurized fluid can flow from the high-pressure region into the control output via the return valve 85, so that the process which has just been described cannot be brought about again by pressurized fluid which flows into the control line and out of the control line. A repeated excitation would namely lead, in the final analysis, to an increased carry-over of pressurized fluid into the low-pressure control groove. Thus, the invention provides in simple fashion a hydraulic system with which the desired control of the actuating elements over a large range of cycle times is obtained with a relatively small pump.

We claim:

1. A hydraulic system, in particular an engine brake for an internal combustion engine (9) having at least one hydraulic actuating element (11), a positive displacement pump (15) by which pressurized fluid can be pumped from a low-pressure region (34) into a high-pressure region (28), and having a distributor unit (14) which has a control output (13) connected via a control line (12) with the actuating element (11), which control output can be pressurized from the high-pressure region (28) and can be connected to the low-pressure region (34), characterized by a return valve (85) which opens towards the high-pressure region (28) and via which the control line (12) can be connected to the high-pressure region (28) after it has been pressurized from the high-pressure region (28) and before it is connected with the low-pressure region (34).

2. A hydraulic system according to claim 1, characterized by the fact that several actuating elements and several control lines which can be separately acted on by pressure are present, and that each of said control lines can be connected to the high-pressure region via a return valve which is associated only with it.

3. A hydraulic system according to claim 1, characterized by the fact that the distributor unit (14) has a distributor rotor (38, 61, 62) which rotates opposite said at least one control output (13), and that the return valve (85) via which the control output (13) and a control line (12) connected to it can be connected to the high-pressure region (28) is arranged on the distributor rotor (38, 61, 62).

4. A hydraulic system according to claim 3, wherein several control outputs (13) are connectable to the high-pressure region (28) by said same return valve (85) which is arranged on the distributor rotor (38, 61, 62).

5. A hydraulic system according to claim 3, wherein that the distributor rotor (38, 61, 62) has a pressure recess (76) via which a control output (13) can be pressurized from the high-pressure region (28) and a relief recess (73) via which the control output (13) can be connected to the low-pressure region (34); the return valve (85) is arranged on the distributor rotor (38, 61, 62); and the control output (13) can be connected with the high-pressure region (28) via a decompression recess (77) which is present between the pressure recess (76) and the relief recess (73) and is separate from said recesses (76, 73); and that this downstream return valve (85) can be connected to the high-pressure region (28).

6. A hydraulic system according to claim 5, characterized by the fact that a sealing bar (78) which is present between the pressure recess (76) and the decompression recess (77) is shorter in the direction of rotation of the distributor rotor (38, 61, 62) than the control outputs (13) lying opposite to the recesses (76, 77).

7. A hydraulic system according to claim 5, wherein a relief groove (108) which is connected to the low-pressure region (34) is contained in a sealing bar (74) of the distributor rotor (62) which is located radially or axially between the decompression recess (77) and the high-pressure region.

8. A hydraulic system, in particular according to claim 5, wherein the pressure recess (76) is separated from the high-pressure region (28) over at least a part of its length by a sealing bar (74) which is present radially or axially between it and the high-pressure region (28).

9. A hydraulic system according to claim 3, wherein the high-pressure region (28) is located radially on the outside or inside on the distributor rotor (62); and that the return valve (85) is so arranged on the distributor rotor (62) that its axis (98) lies at least approximately in a radial plane.

10. A hydraulic system according to claim 1, wherein a the closure member (88) of the return valve (85) is made of a ceramic material.

11. A hydraulic system according to claim 1, wherein a the closure member (88) of the return valve (85) can be acted on in closing direction from the high-pressure region (28).

12. A hydraulic system according to claim 11, wherein a plurality of n>1 discharge-side holes (99) pass through a valve housing (87) of the return valve (85) which receives and guides the closure member (88) in a central hollow space (91), said holes (99) extending in the axial direction of the return valve (85) and being arranged in n-time symmetry to the axis (98) of the return valve (85) and debouch at least with a part of the cross section axially into the hollow space (91).

13. A hydraulic system according to claim 12, the holes (29) cut the hollow space (91) from radially outwards.

14. A hydraulic system according to claim 13, wherein another discharge-side hole (97) of the valve housing (87) debouches centrally into the hollow space (91).

15. A hydraulic system according to claim 4, wherein the distributor rotor (38, 61, 62) has a pressure recess (76) via which a control output (13) can be pressurized from the high-pressure region (28) and a relief recess (73) via which the control output (13) can be connected to the low-pressure region (34); the return valve (85) is arranged on the distributor rotor (38, 61, 62); and the control output (13) can be connected with the high-pressure region (28) via a decompression recess (77) which is present between the pressure recess (76) and the relief recess (73) and is separate from said recesses (76, 73); and that this downstream return valve (85) can be connected to the high-pressure region (28).

16. A hydraulic system according to claim 10, wherein said material is silicon nitride.

* * * * *